US006182866B1

(12) United States Patent
Keller

(10) Patent No.: US 6,182,866 B1
(45) Date of Patent: Feb. 6, 2001

(54) MANUALLY OPERATED DISPENSING DEVICE HAVING A FRICTION BRAKE ACTING UPON A THRUST ROD

(76) Inventor: Wilhelm A. Keller, Obstgartenweg 9, CH-6402 Merlischachen (CH)

( * ) Notice: Under 35 U.S.C. 154(b), the term of this patent shall be extended for 0 days.

(21) Appl. No.: 09/285,243

(22) Filed: Apr. 2, 1999

(30) Foreign Application Priority Data

Apr. 8, 1998 (EP) ..... 98810302

(51) Int. Cl.[7] ..... B67D 5/52

(52) U.S. Cl. ..... 222/137; 222/326; 222/340; 222/391

(58) Field of Search ..... 222/137, 145.5, 222/326, 327, 340, 391

(56) References Cited

U.S. PATENT DOCUMENTS

| | | | | |
|---|---|---|---|---|
| 4,452,285 | * | 6/1984 | Liebhard et al. | 222/391 |
| 4,826,053 | | 5/1989 | Keller | 222/340 |
| 4,923,096 | | 5/1990 | Ennis, III | 222/391 |
| 5,248,068 | * | 9/1993 | Goergen et al. | 222/391 |
| 5,400,925 | | 3/1995 | Simmen | 222/137 |
| 5,425,590 | * | 6/1995 | Duty et al. | 222/391 |
| 5,653,363 | | 8/1997 | Chang | 222/391 |

FOREIGN PATENT DOCUMENTS 791 404 8/1997 (EP) .

* cited by examiner

*Primary Examiner*—Joseph A. Kaufman
(74) *Attorney, Agent, or Firm*—Foley & Lardner

(57) ABSTRACT

The manually operated dispensing device comprises a friction brake acting upon a thrust rod. The friction brake consists of a brake spring comprising a loop portion having a radius, and an attached clamping portion having two legs for receiving between them a web extending on the thrust rod in lengthwise direction and normally to the toothing plane of the thrust rod. One of the legs is straight-lined whereas the other leg is curved or angularly bent from the loop portion. In this way, the brake spring is asymmetric with respect to its longitudinal axis, and the straight-lines portion acts for lining up the toothing of the thrust rod to the toothing of a drive member. Such a friction brake which consists of a spring only, can be manufactured and mounted in a simple and low-cost manner and aligns nevertheless the thrust rod in an efficient way.

11 Claims, 2 Drawing Sheets

MANUALLY OPERATED DISPENSING DEVICE HAVING A FRICTION BRAKE ACTING UPON A THRUST ROD

BACKGROUND OF THE INVENTION

1. Field of the Invention

The present invention refers to a manually operated dispensing device for cartridges, comprising a friction brake acting upon a thrust rod, said friction brake having a brake spring which frictionally acts upon the thrust rod. The latter comprises a toothing coacting with a corresponding toothing of a drive member.

The first and major task of friction brakes is to allow a relief stroke of the thrust rod after each advance stroke, said relief stroke being dictated by the relief of the flexible cartridges. That is, the friction brake should not substantially hinder the thrust rod but efficiently neutralize the trailing force being created by the drive member during grip regain and acting upon the thrust rod. Whereas the thrust rod, or the thrust rods in the case of a two-component cartridge, is guided during the advance motion by being in meshing engagement with the drive member, there is a risk during grip regain that the thrust rod is pushed somewhat offset, and the precise meshing with the teeth of the drive members is no longer guaranteed.

2. Description of the Prior Art

A dispensing device such as mentioned above has already become known from U.S. Pat. No. 4,826,053 to the same Applicant. The friction brake which has been disclosed in that document is composed of many single parts which occupy a rather great space and do not allow an alignment.

The document EP-A-0,791,404, to the same Applicant too, discloses a simplified friction brake which consists of an omega shaped spring only. It has turned out, however, that such an omega shaped spring is difficult to be adjusted to the dimensions of the thrust rod and, moreover, does not align the thrust rod.

SUMMARY OF THE INVENTION

Starting from this prior art, it is an object of the present invention to provide a manually operated dispensing device comprising a friction brake that does not exhibit the above discussed drawbacks and that contains a low-cost friction brake which efficiently holds the thrust rod in position during grip regain and which aligns moreover the thrust rod, or double thrust rod in case of two-component cartridges, in such a way that the toothing of the drive member can perfectly mesh with the toothing of the thrust rod during grip regain. These objects are attained by a manually operated dispensing device of the above depicted kind wherein both the brake spring that acts as a friction brake and also the housing of the device comprise means for lining up the toothing of the thrust rod with the toothing of the drive member. Other advantages and features will be defined in the description of embodiments below and in the dependent claims.

BRIEF DESCRIPTION OF THE DRAWING

The invention shall now be explained in greater detail in the following by means of an embodiment which is shown in the drawing wherein.

DETAILED DESCRIPTION OF THE INVENTION

In the present application, only those parts of the dispensing device are described that are necessary for understanding the new friction brake, its functions and its effects. As to the other parts and the functional features of the dispensing device, see the above mentioned document EP-A-0,791,404 which is incorporated by reference into the present document.

Figure 2:
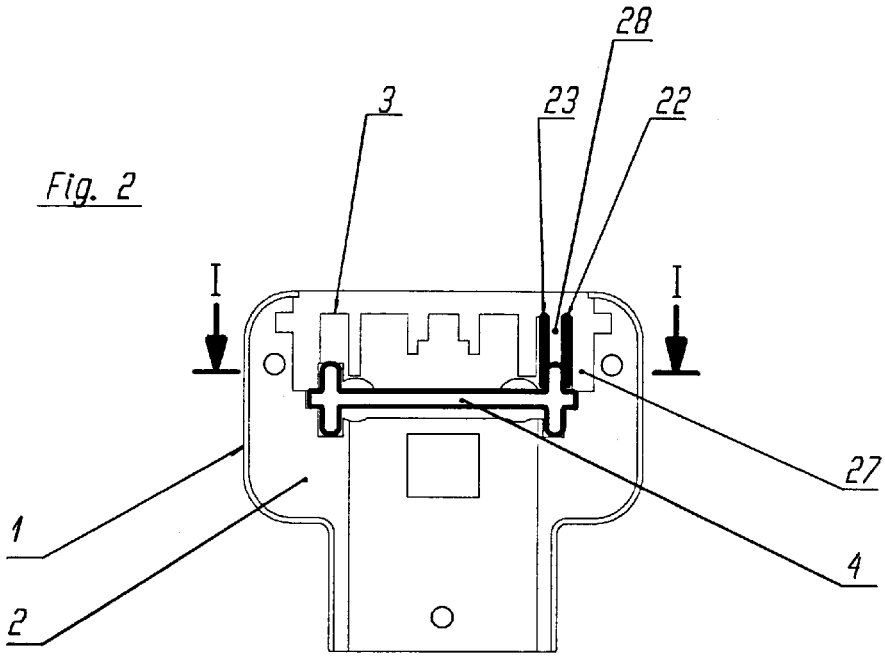
FIG. 2 shows a sectional view according to line II—II in FIG. 1.
Figure 1:
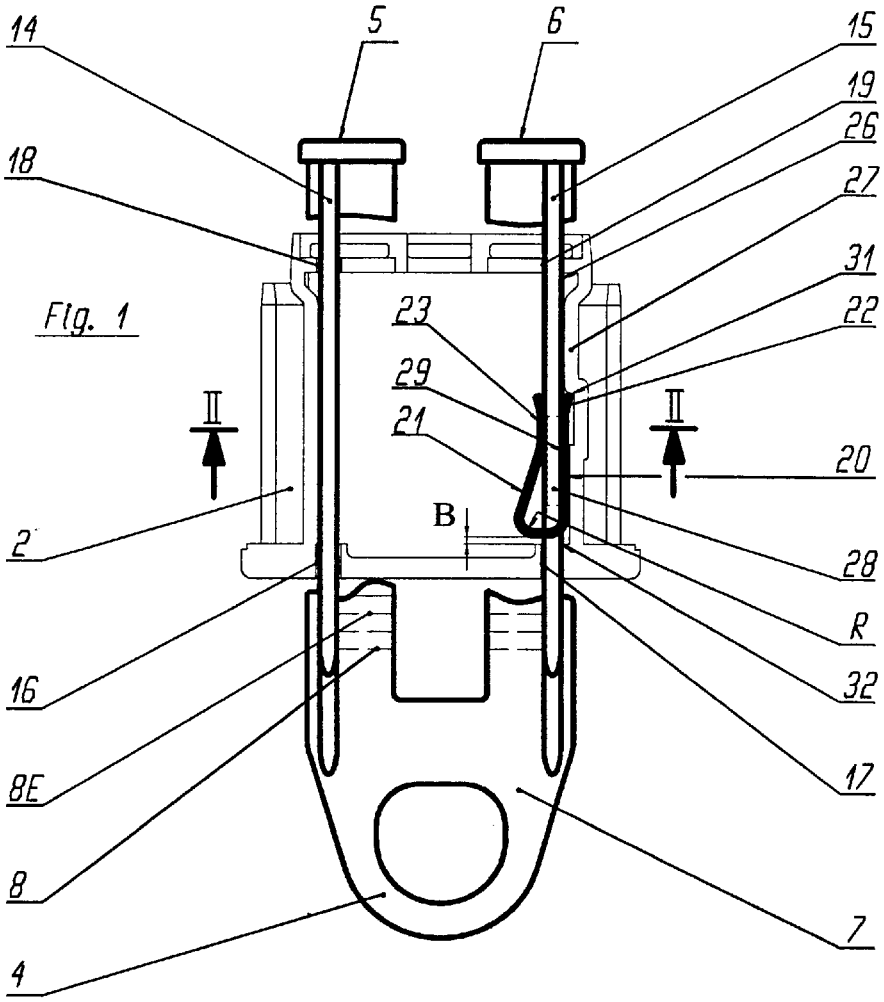
FIG. 1 shows a sectional view in the plane of the thrust rods according to line I—I in FIG. 2.
Figure 3:
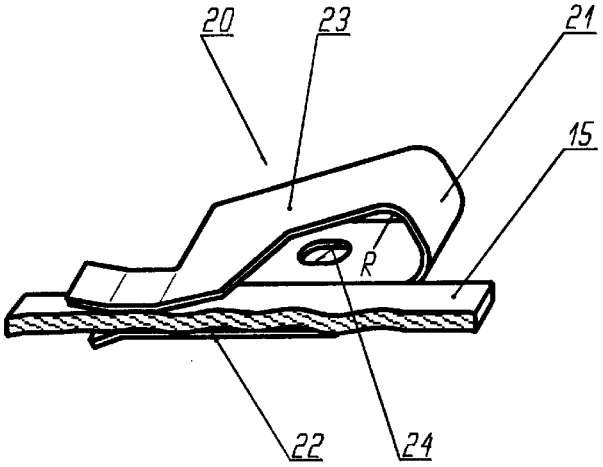
FIG. 3 shows a perspective view of a brake spring.
Figure 4:
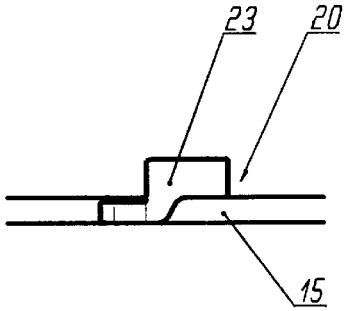
FIG. 4 shows the brake spring of FIG. 3 in inserted position.

FIGS. 1 and 2 show a portion of the housing 1 which essentially consists of the housing body 2 and the cover 3. Further, the double thrust rod 4 can be distinguished which is called in the following "thrust rod" only since it is not essential for this invention whether the thrust rod is a single or a double one. The thrust rod 4 carries thrust plates 5 and 6 which may have the same cross sectional area or, for cartridges having different volumes or cross sectional areas, respectively, different cross section areas. In the present description, the notion "front" or "frontal" refers to the thrust plate end, and "rear" or "posterior" to the other, free end of the thrust rod.

Figure 6:
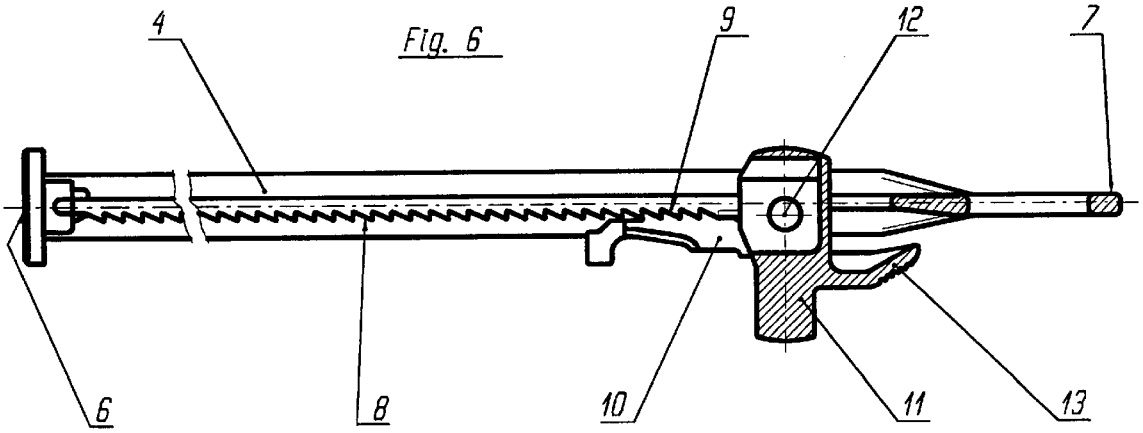
FIG. 6 shows a partly sectioned side elevation view of a thrust rod and a drive member.

The thrust rod 4 which is represented has a tongue 7 at its rear end (see FIG. 6) to allow its manually operated retraction when a cartridge is to be changed. The thrust rod 4 further contains a toothing 8, see also FIG. 6, which is engaged by a catch 10 of a drive member 11 provided with a toothing 6. Further, FIG. 6 shows the fulcrum 12 of the drive member as well as the lever 13 for pivoting the drive member and disengage the teeth and to enable in this manner the retracting movement of the thrust rod.

A precise guidance of the thrust rods and an exact meshing of the teeth of the drive member with those of the thrust rods is important for the perfect functioning of the advance and of the relief path as well as of the regain grip. In a first approximation, this guidance is accomplished in that the thrust rods comprise webs 14 and 15 which extend lengthwise of the thrust rod and are normal to the plane 8E on which the toothing 8 is disposed, and that these webs are guided in correspondingly shaped guide portions within the housing; corresponding rear guide portions 16 and 17 as well as front guide portions 18 and 19 being shown in FIG. 1. As it will be understood from the following description and the functioning of the friction brake, it is important that at least one thrust rod comprises at least one web that is directed upward, namely towards the cover of the housing.

If a precise guidance should be effected with these measures alone, the guiding grooves or slots as well as the webs on the thrust rods would have to be realized in a very exact manner and with only very small tolerances. Such small tolerances are however not possible in the large scale manufacturing of these products. Now, it has been found that it is possible not only to meet all requirements an effective friction brake calls for, but also to bring about an exact guidance of the thrust rod, be it a single one or a double thrust rod.

FIGS. 1 to 5B show a friction brake which is shaped as a brake spring 20 and not only performs all functions of a friction brake but also precisely guides the thrust rod when the teeth of the drive member must anew be engaged. According to FIG. 3, the spring 20 essentially consists of a loop portion 21 having a radius R, and a clamp and line-up portion attached thereto and comprising the legs 22 and 23. As it can best be seen in FIGS. 1 and 5, one leg 22 is straight whereas the other leg 23 is curved or bent so that the whole spring is asymmetrical with respect to its longitudinal axis. The straight leg 22 further comprises an oblong hole 24 for safety and path limiting purposes.

By this special spring design, it is achieved, on one hand, that the thrust rod or its web, respectively, in the present Example web 15 (FIG. 1), is always linearly lined up and is pressed against both outer edges 25 and 26 of the rear guide 17 and the front guide 19, respectively. On the other hand, the shape of the loop portion allows a precise adjustment of the spring force by changing the value of the radius R, and by selecting the material thickness and nature.

Figure 5A:
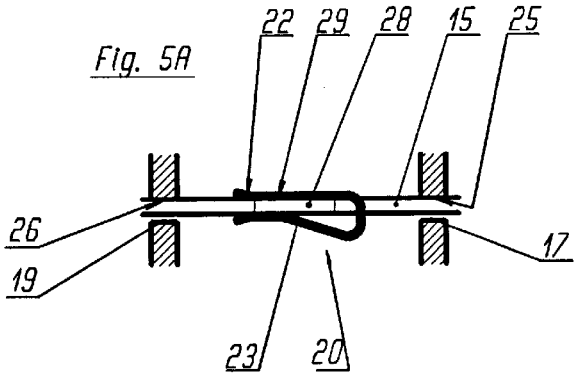
FIGS. 5A and 5B show two different positions of the thrust rod within the guide members.

The aligned position according to FIG. 1 corresponds to the thrust rod position of FIG. 5A where it is indicated that the web 15 of the thrust rod contacts the edges 25 and 26 of the guides 17 and 19, respectively.

In the present embodiment, the spring is fixed to the cover of the housing, the spring being disposed at the inner surface of the outer wall 27 of the cover, and is clamped between the inner face of the outer wall and a guide web 28 extending in a distance from said wall. The guide web serves for precisely aligning the straight leg 22 of the brake spring, the two guide edges 25 and 26 being in the same plane together with the stop surface 29 of the guide web 28, said surface facing the outer wall of the cover 27. The height of the guide web roughly corresponds to the height of the step 30 of the brake spring, see FIG. 3, so that the web 15 slides beneath the guide web 28. It goes without saying that the guide web 28 is somewhat thinner than the web 15 which is thus efficiently pinched by the spring.

Two limit stops for the brake spring are provided at the inner surface of the outer wall 27, namely a front stop 31 and a rear stop 32. The path along which the brake spring recedes and which is defined as a free relief path is referenced as B in FIG. 1. A pin (not shown) which traverses the outer wall 27 and the oblong hole 24 and which further limits the free relief path is provided for securing the brake spring so that the latter is secured but remains displaceable in lengthwise direction over a predetermined path.

In the following, the functioning of the friction brake according to the invention will be described.

Figure 5B:
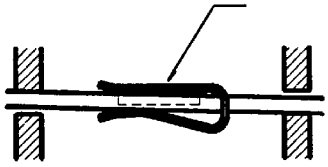

Under charge, i.e. during dispensing, the thrust rod remains aligned with respect to the housing, even if different forces are applied to the thrust rod; this is in particular the case with a double thrust rod when the ratio of the cartridge volumes of the cross section ratio, respectively, deviates from a 1:1 ratio and is for example 1:4 or 1:10: the saw tooth like engagement by the drive member aligns the thrust rod to the catch of the drive member which has a small play only. During the relief path and the grip regain stroke by the catch, however, this alignment is no longer present since different forces or friction conditions may provoke a lateral displacement or an inclination of the thrust rod as it is shown in FIG. 5B.

After the end of the regain stroke, the somewhat tensed brake spring aligns the thrust rod again to the front and rear edges 25 and 26 of the guide portions whereas the straight leg 22 of the spring is lined up to the stop surface 29 of the guide web where it abuts. The result is that, during the regain grip and at the beginning of the dispensing stroke, the toothing of the thrust rod and the catch teeth are precisely aligned to each other, and the catch will not get caught during the engaging step by improper tooth engagement which could damage the toothing of the thrust rod and the catch and create cracking noise.

It follows from the above description that the alignment of the thrust rod by the brake spring of the invention is performed by the brake spring alone in a perfect manner, and the part and mounting costs can strongly be reduced which is essential with large scale manufacture. Furthermore, the thrust rod has only a very small friction with respect to the housing. This effect is favorable for the relief of the cartridge.

The brake spring of the invention has been described by means of an example of a double cartridge where it is of particular usefulness since the brake spring needs to act on one web of the thrust rod only for aligning the whole thrust rod, namely the double thrust rod; it is irrelevant whether the thrust plates of the thrust rod express cartridges having a cross section ratio of 1:1 or a different one until a ratio of 1:10. The brake spring of the invention may however also be used in dispensing devices having only one thrust rod.

I claim:

1. Manually operated dispensing device for cartridges, comprising:

a housing having a cover and a friction brake acting upon a thrust rod, said friction brake comprising a brake spring which frictionally acts upon the thrust rod, said thrust rod being provided with a toothing that coacts with a corresponding toothing of a drive member, wherein the brake spring and the housing of the device align the toothing of the thrust rod with the toothing of the drive member.

2. The dispensing device according to claim 1, wherein said brake spring comprises a loop portion having a radius and a clamp portion attached to said loop portion and comprising two legs for receiving a web extending lengthwise on said thrust rod and normally to its toothing plane, one of said legs being straight-lined and the other being curved or angularly bent, said brake spring thus being asymmetric respective to its longitudinal axis, said straight-lined portion serving for alignment.

3. The dispensing device according to claim 2, wherein the resiliency of said brake spring is adjustable by changing said radius of the loop portion.

4. The dispensing device according to claim 2, wherein said brake spring is disposed in the cover of the housing of the dispensing device, said straight-lined leg being clamped between the inner surface of an outer wall of said cover and a guide web disposed in distance from this outer wall.

5. The dispensing device according to claim 2, wherein said web of said thrust rod is guided in guide slots, and the guide web has a stop surface directed towards said outer wall, the outer guiding edges of said guide slots and the stop surface of the guide web being disposed on a straight line.

6. The dispensing device according to claim 1, wherein the device is configured to receive a double cartridge and wherein said thrust rod is comprised of a a double thrust rod that includes two thrust rods, at least one of said two thrust rods includes at least one web directed towards said cover, said brake spring acting on said web.

7. The dispensing device according to claim 6, wherein the two thrust rods of the double thrust rod each act on a respective one of two thrust plates.

8. The dispensing device according to claim 7, wherein the two thrust plates have different cross-sectional areas, the ratio of said cross-sectional areas being up to 1:10.

9. The dispensing device according to claim 7, wherein the two thrust plates have different cross-sectional areas.

10. A brake spring for use as a friction brake in a dispensing device for cartridges, wherein said brake spring comprises a loop portion having a radius and a clamp portion attached to said loop portion and comprising two legs, one of said legs being straight-lined and the other being curved or angularly bent, said brake spring thus being asymmetric respective to its longitudinal axis.

11. The brake spring according to claim 10, wherein said straight-lined leg comprises an oblong hole for receiving a pin acting as a securing member and for limiting the relief path.

* * * * *